US006888500B2

(12) United States Patent
Brown et al.

(10) Patent No.: US 6,888,500 B2
(45) Date of Patent: May 3, 2005

(54) BEAM STEERING WITH A SLOT ARRAY

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/459,067

(22) Filed: Jun. 11, 2003

(65) Prior Publication Data

US 2004/0252054 A1 Dec. 16, 2004

(51) Int. Cl.[7] ..... H01Q 3/24
(52) U.S. Cl. ..... 342/372
(58) Field of Search ..... 342/368, 372, 342/374; 343/746, 767, 754, 757

(56) References Cited

U.S. PATENT DOCUMENTS

| | | | | |
|---|---|---|---|---|
| 3,231,892 A | | 1/1966 | Matson et al. | |
| 4,684,952 A | | 8/1987 | Munson et al. | |
| 5,162,972 A | | 11/1992 | Gripshover et al. | |
| 5,736,915 A | * | 4/1998 | Goedde et al. | 336/55 |
| 6,515,235 B2 | | 2/2003 | Moller | |
| 2003/0006140 A1 | * | 1/2003 | Vacca et al. | 204/547 |

OTHER PUBLICATIONS

U.S. Appl. No. 10/369,436, Rawnick et al., filed Feb. 18, 2003.
U.S. Appl. No. 10/387,208, Rawnick et al., filed Mar. 11, 2003.
U.S. Appl. No. 10/330,755, Rawnick et al., filed Dec. 27, 2002.
U.S. Appl. 10/330,754, Rawnick et al., filed Dec. 27, 2002.
U.S. Appl. No. 10/300,456, Rawnick et al., filed Nov. 19, 2002.
U.S. Appl. No. 10/361,548, Rawnick et al., filed Feb. 10, 2003.
U.S. Appl. No. 10/387,209, Rawnick et al., filed Mar. 11, 2003.
U.S. Appl. No. 10/387,194, Brown et al., filed Mar. 11, 2003.
U.S. Appl. No. 10/438,435, Brown et al., filed May 15, 2003.
U.S. Appl. No. 10/414,696, Brown et al., filed Apr. 16, 2003.
U.S. Appl. No. 10/637,027, Brown et al., filed Aug. 7, 2003.
U.S. Appl. No. 10/414,650, Brown et al., filed Apr. 16, 2003.
U.S. Appl. No. 10/635,629, Brown et al., filed Aug. 6, 2003.
U.S. Appl. No. 10/438,436, Rawnick et al., filed May 15, 2003.

(Continued)

*Primary Examiner*—Dao Phan
(74) *Attorney, Agent, or Firm*—Sacco & Associates, PA

(57) ABSTRACT

System and method for controlling an antenna beam. The system can include a slot array (100) having a plurality of slot elements (102) and a fluid control system (206, 207, 302) responsive to a control signal 301. The fluid control system can independently vary a selected volume of a fluid dielectric (300) coupled to each of the slot elements (102). In so doing, the system can steer and shape an electromagnetic field incident on the slot array. The slot array (100) can optionally comprise at least one conductive ground plane (308) for reflecting the incident electromagnetic field.

26 Claims, 5 Drawing Sheets

OTHER PUBLICATIONS

U.S. Appl. No. 10/626,090, Brown et al., filed Jul. 24, 2003.
U.S. Appl. No. 10/635,582, Rawnick et al., filed Aug. 6, 2003.
U.S. Appl. No. 10/632,632, Rawnick et al., filed Aug. 1, 2003.
U.S. Appl. No. 10/614,149, Brown et al., filed Jul. 7, 2003.
U.S. Appl. No. 10/634,219, Rawnick et al., filed Aug. 5, 2003.
U.S. Appl. No. 10/458,859, Rawnick et al., filed Jun. 11, 2003.
U.S. Appl. No. 10/624,378, Brown et al., filed Jul. 22, 2003.
U.S. Appl. No. 10/438,433, Rawnick et al., filed May 15, 2003.
U.S. Appl. No. 10/460,947, Rawnick et al., filed Jun. 13, 2003.
U.S. Appl. No. 10/421,352, Rawnick, et al., filed Apr. 23, 2003.
U.S. Appl. No. 10/409,261, Pike, filed Apr. 8, 2003.
U.S. Appl. No. 10/441,743, Pike, filed May 19, 2003.
U.S. Appl. No. 10/628,846, Pike et al., filed Jul. 28, 2003.
U.S. Appl. No. 10/448,973, Delgado et al., filed May 30, 2003.
U.S. Appl. No. 10/300,455, Brown et al., filed Nov. 19, 2002.

* cited by examiner

BEAM STEERING WITH A SLOT ARRAY

BACKGROUND OF THE INVENTION

1. Statement of the Technical Field

The inventive arrangements relate generally to methods and apparatus for steerable beam antennas, and more particularly to array structures that can be used for steering antenna beams.

2. Description of the Related Art

Beam steering relates to changing the direction of a beam emitted from an antenna. In general, there are two ways to steer the beam of an antenna: mechanically and electrically. A mechanically scanned antenna uses a gimbal or other device to physically change the direction the antenna is pointing. An electrically steered antenna uses an array of elements onto which a progressive phase shift is applied. This progressive phase shift along the array determines the direction from which the energy will add in phase when summed by the array. It will be appreciated that these structures are generally reciprocal in their operation. If the system will steer a transmitted beam, it will also steer the received beam in a similar way.

There are several ways to make reflective structures perform a beam steering function. A simple flat conducting plate can be used to perform beam steering by moving the orientation of the reflector plate. The same effect can be achieved using a flat conductive plate covered by a uniform dielectric. However, it is often desirable to steer the beam without the need for gross mechanical movement of the reflector plate. Conventional reflectarrays can perform this function electronically. One example of a reflectarray is disclosed in U.S. Pat. No. 4,684,952 to Munson et al. However, alternative arrangements are also known in the art.

A frequency selective surface (FSS) is conventionally designed to either block or pass electromagnetic waves at a selected frequency, but is not generally used for beam steering. These types of surfaces are generally comprised of a conducting sheet periodically perforated with closely spaced apertures, or an array of periodic metallic patches. One or more layers formed with such structures can be used in the FSS.

FSS arrays that use metallic patches are sometimes called wire arrays. The patches can be formed in a dipole configuration or can have more than two-fold symmetry. For example, the patches can be tripoles or quadrupoles. FSS arrays that use openings in an otherwise continuous conductive sheet are commonly referred to as slot arrays. Slot and wire arrays can be combined in a single FSS having multiple layers. Optionally, a ground plane may be included as one of the layers of the FSS if the surface is to have reflective properties.

In general, an FSS comprised of wire arrays will be reflective in some frequency band (called the stopband) and transmissive at other frequencies. Conversely, slot arrays are generally transmissive in some frequency band (called the passband) and reflective at other frequencies. The phase shift caused by the FSS with respect to reflected or transmitted waves varies significantly in the transition region between passband and stopband. An FSS over a ground plane is of course entirely reflective, but the phase of the reflected wave will be different in the passband and stopband.

Many types of FSS element configurations are known, including circles, Jerusalem crosses, dipoles, tripoles, quadrupoles, concentric rings, mesh-patch arrays or double squares supported by a dielectric substrate. Depending upon the geometry selected, these can combine features of inductive and capacitive elements and can be used to provide low-pass, high-pass, or band-pass responses. U.S. Pat. No. 3,231,892 describes some basic FSS geometries and one potential application for an FSS type periodic resonance structure. Notably, signals that are blocked by an FSS are typically reflected away from the FSS, but the reflected direction is often not a matter of concern for the designer.

Properties of the FSS, such as frequency response, are determined by element shape in arrays, element spacing in arrays, properties of dielectric materials comprising the FSS, and the presence or absence of a ground plane. With regard to the dielectric, it is known that FSS properties are significantly affected by the permittivity/permeability of the material in close proximity to the array layers.

SUMMARY OF THE INVENTION

The invention concerns a system and method for controlling an antenna beam. The system can include a slot array having a plurality of slot elements and a fluid control system responsive to a control signal. The fluid control system can independently vary a selected volume of a fluid dielectric coupled to each of the slot elements. In so doing, the system can steer and shape an electromagnetic field incident on the slot array. The slot array can optionally comprise at least one conductive ground plane for reflecting the incident electromagnetic field. Also, a fixed beam source for the electromagnetic field can be provided for generating the incident electromagnetic field.

The slot array can be formed of a conductive sheet having a plurality of slot elements formed as shaped perforations in the conductive sheet. The conductive sheet can be supported over an air dielectric or disposed over a dielectric substrate. An array of cavity structures can be provided for containing the fluid dielectric coupled to the slot elements. The cavity structures are preferably formed from a dielectric. For example, if a dielectric substrate is used, the cavity structures can be defined within the substrate.

The fluid control system can be comprised of one or more fluid control components such as a fluid reservoir, a pump, a valve and a controller. According to one aspect of the invention, one or more components of the fluid control system can be at least partially shielded from the electromagnetic field by the conductive sheet.

Further, the slot array can be configured as a frequency selective surface. The frequency selective surface can be transmissive or reflective at a predetermined operating frequency corresponding to the electromagnetic field. Alternatively, the frequency selective surface can have a transition region between a stopband and a passband, and the slot array can be configured for operation in the transition region at a predetermined frequency corresponding to the electromagnetic field.

According to yet another aspect of the invention, the slot elements can be configured as tripoles. In that case, the fluid dielectric can be advantageously constrained in an area corresponding to an intersection of each arm of the tripole.

The invention can also include a method for controlling an electromagnetic field. The method can include the steps of positioning a slot array in a path of an incident electromagnetic field and selectively varying a volume of a fluid dielectric coupled to each of the slot elements in the array. In this way, the direction of travel of the electromagnetic field and a shape of the electromagnetic field can be selectively modified.

DETAILED DESCRIPTION OF THE PREFERRED EMBODIMENTS

Figure 1:
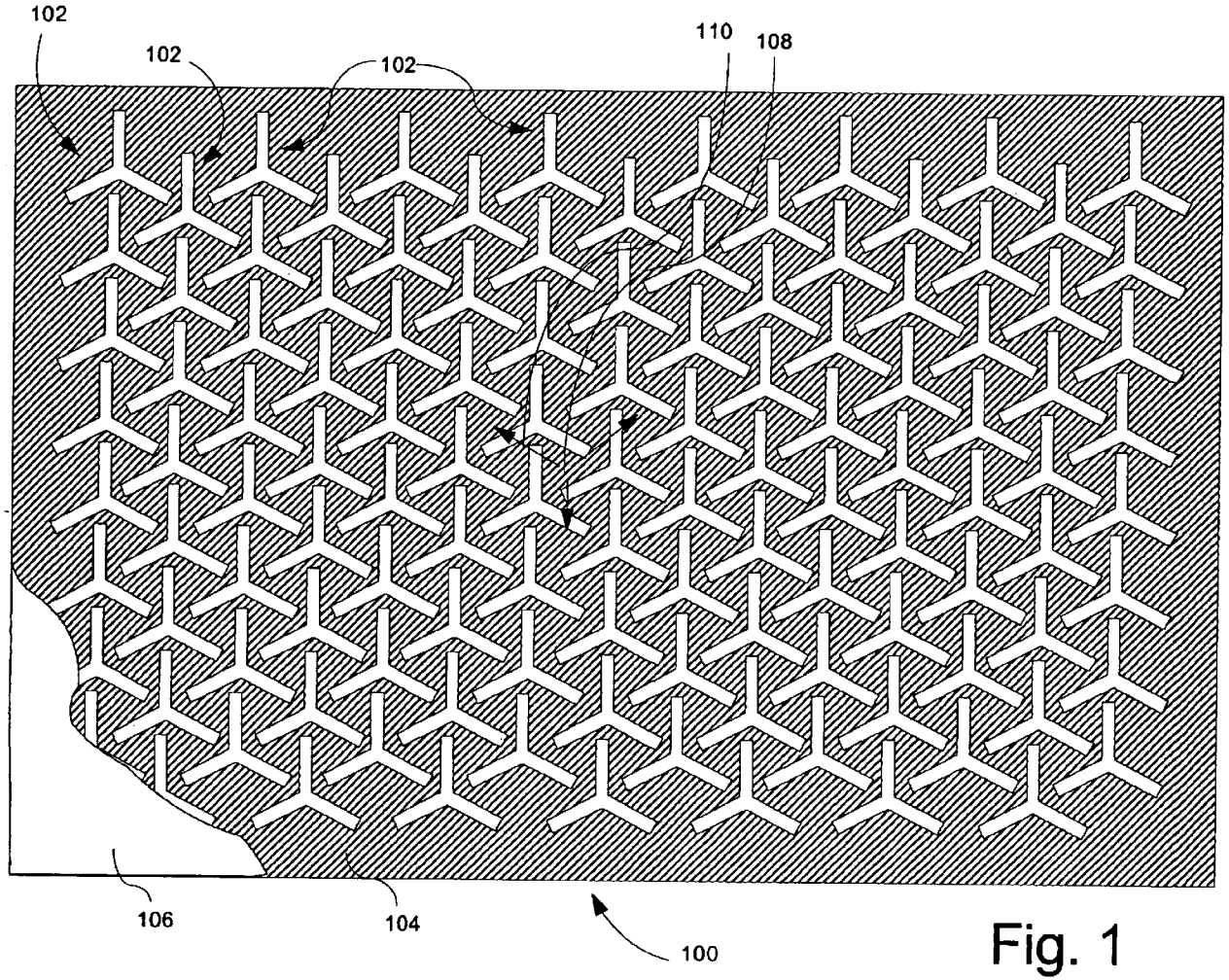
FIG. 1 is a partial cutaway top view of an FSS comprised of a plurality of elements and which is useful for understanding the invention.

The present invention controls the electrical characteristics of a dielectric layer associated with a frequency selective surface to perform beam steering. FIG. 1 is a partial cutaway top view of a slot array 100 that can comprise a frequency selective surface. The slot array 100 is comprised of a conductive sheet 104 which can be disposed over a dielectric substrate 106. In FIG. 1, conductive sheet 104 is shown partially cutaway to reveal the dielectric substrate 106. The elements 102 of the slot array are formed as shaped perforations in the conductive sheet 104. In FIG. 1, the shaped perforations defining elements 102 are tripoles. However, it should be understood that the invention is not limited to any particular slot shape. Instead, the invention described herein can preferably be used with any type of slot array, including but not limited to arrays formed of slots in the shape of circles, Jerusalem crosses, dipoles, tripoles, quadrupoles, squares and so on.

Figure 2:
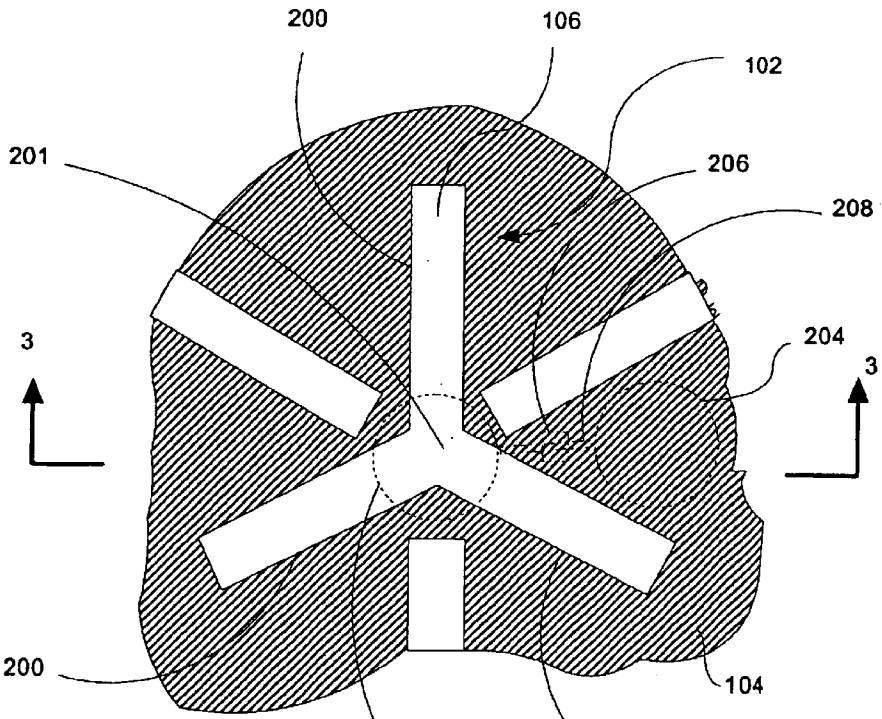
FIG. 2 is an enlarged view of an element of the FSS in FIG. 1.

FIG. 2 is an enlarged view of a typical element 102 of the slot array 100. According to a preferred embodiment, the structure of the dielectric substrate 106 can be formed to define at least one cavity structure 202 within the dielectric substrate 106 in an area generally aligned with element 102. The cavity structure can be co-extensive with the area defined by element 102, less than the total area defined by element 102 or can extend somewhat beyond the limits of element 102. If a tripole element is used as shown in FIG. 2, the cavity structure 202 is preferably positioned at the intersection 201 of element arms 200 as shown for maximum effect.

Figure 6:
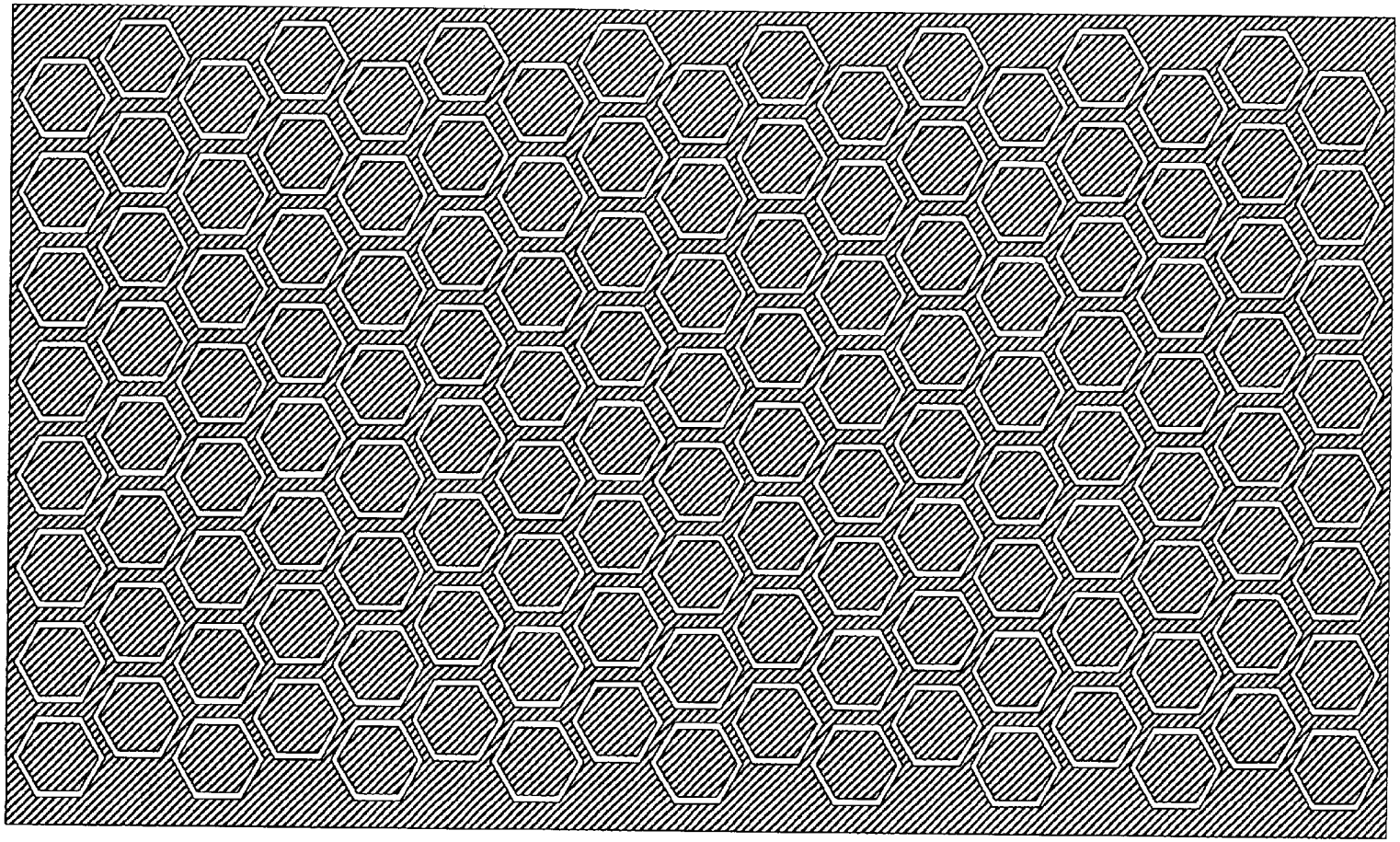
FIG. 6 is a top view of an FSS comprised of a plurality of hexagonal loop slots.

Notably, the cavity structure 202 shown in FIG. 2 is less than the total area defined by element 102 and extends slightly beyond the area defined by element 102. However, the invention is not so limited. For example, FIG. 6 shows a hexagonal slot array in which it can be desirable to allow the cavity structure to be co-extensive with the area defined by the slot.

Figure 3:
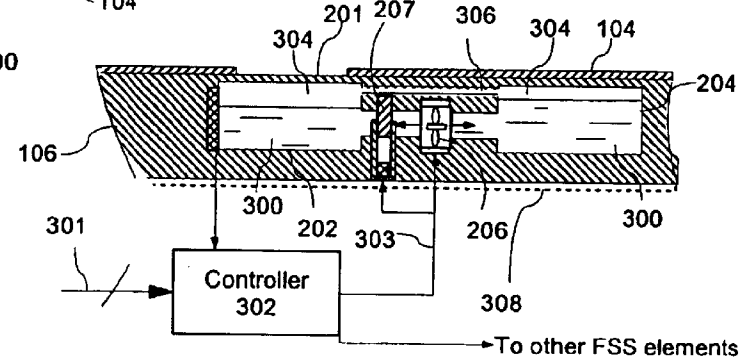
FIG. 3 is a cross-sectional view of the element in FIG. 2.

FIG. 3 is a cross-sectional view taken along line 3—3 in FIG. 2. As shown in FIGS. 2 and 3, a reservoir 204 can be provided in fluid communication with the cavity structure 202. A fluid control system can be provided for moving a volume of fluid dielectric 300 between reservoir 204 and cavity structure 202. The fluid control system can comprise any combination of pumps, valves, sensors and electronic controls suitable for selectively varying a volume of fluid in the cavity structure 202 in response to a control signal. For example, in FIG. 3 there is provided a pump 206, a valve 207, fluid sensors 209 and an electronic controller 302. However, the invention is not limited to the precise fluid control arrangements shown, and those skilled in the art will readily appreciate that numerous alternative arrangements are also possible.

The pump 206 and valve 207 can be of the conventional miniature variety or can be formed as micro electromechanical devices, either or both of which can optionally be integrated into the dielectric substrate 106. Similarly, reservoir 204 can be external to the dielectric substrate 106 or can be formed integral therewith as shown in FIGS. 2 and 3. According to a preferred embodiment, the reservoir 204, the pump 206, and valve 207 can be located beneath the conductive sheet 104 so as not to interfere with the electrical operation of the slot array. In fact, this is an advantage of a slot array in this application to the extent that the conductive sheet 104 can be used to effectively shield the fluid control system. More particularly, the shielding provided by the conductive sheet can be used to limit or prevent any direct beam steering interaction which might otherwise be associated with the fluid dielectric contained within the control system. Instead, such beam steering interaction will primarily occur with the fluid dielectric 300 contained in the unshielded area associated with cavity structure 202.

The pump 206 and valve 207 associated with each element 102 is preferably operable independently from corresponding pumps and valves associated with other elements 102. According to a preferred embodiment, the pump 206 and valve 207 can each be controlled in response to an element control signal 303 from the controller 302.

According to one embodiment, the portion 304 of cavity structure 202 and reservoir 204 not occupied by fluid dielectric 300 can be occupied by an inert gas. Vent tube 306 allows displacement of any of the inert gas contained within the cavity structure 202. If the relative permeability or permittivity of the fluid dielectric is selected to be different as compared to the inert gas, then increasing or decreasing the amount of fluid dielectric 300 contained within the cavity structure 202 will vary the phase shift of signals traversing through the element 102.

According to an alternative embodiment, the portion 304 of the cavity structure and reservoir 204 not occupied by the fluid dielectric 300 can be occupied by a second fluid dielectric with electrical properties different as compared to fluid dielectric 300. In that case, the second fluid dielectric can be selected to be immiscible with the first fluid dielectric so as to define an immiscible fluid interface between the two fluids. An example of immiscible fluids would include oil and water.

Figure 4:
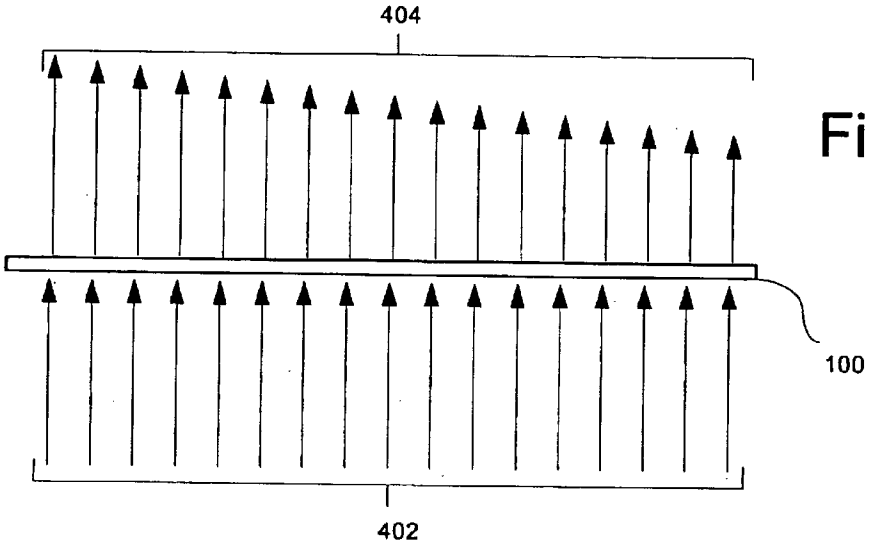
FIG. 4 is a drawing that is useful for understanding the transmissive beam steering that can be performed using the present invention.

The volume of fluid in each cavity structure 202 can be selectively varied to control the amount of phase shift that occurs in each element. For example, if this variance is linear across the surface of the slot array 100, then the transmitted beam which passes through the slot array 100 will be steered in proportion to the phase shift from element to element. The foregoing concept is illustrated in FIG. 4. As shown therein, each incident ray path 402 and transmitted ray path 404 ray is represented for equal time. Paths with less delay are illustrated by longer rays that cover more distance in the same amount of time. By creating a linear variance in the volume of fluid contained in the cells along a direction from left to right in FIG. 4, the wave front is tilted as shown.

Further, by varying the volume of fluid dielectric in accordance with other patterns, it is possible to vary the shape of the transmitted beam. For example, as show in FIG.

1, increasing or decreasing the amount of fluid dielectric contained in each cell in a radial direction 110 away from a center 108 of the surface defined by the slot array can selectively widen or narrow the transmitted beam.

Figure 5:
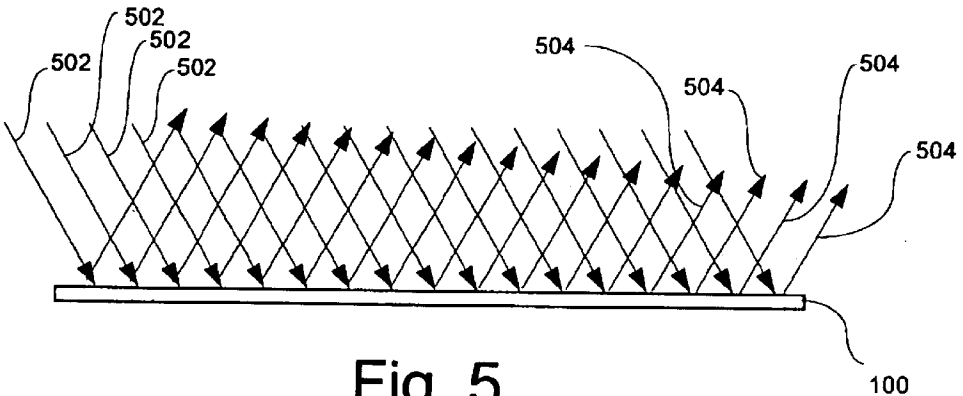
FIG. 5 is a drawing that is useful for understanding reflective beam steering.

Those skilled in the art will appreciate that the foregoing techniques can also be adapted for use in a reflective-type slot array. For example, in FIG. 3, an optional ground plane 308 can be provided so that the slot array 100 can be used in the manner of a conventional reflect-array. Referring to FIG. 5, the theory of operation of such a reflectarray is illustrated. As shown therein, a plurality of incident rays 502 which have some angle of arrival relative to the surface of substrate slot array 100, can be redirected at a second angle to form a redirected rays 504. The precise mechanism by which the beam is redirected will be determined by the relative phase shift introduced to the incident signal by each element 102 of the array. Additional detail regarding such beam steering techniques are described in U.S. Pat. No. 4,684,592, the disclosure of which is expressly incorporated herein by reference.

For convenience, the slot array structures shown in the figures are flat. However, it should be appreciated that the invention is not so limited. For example, the invention can also be used in connection with curved surface slot arrays. A curved surface will modify beam shape as well as direction, and curved reflectors are more often used for beam shaping as opposed to beam steering. However, those skilled in the art will readily appreciate that the concepts disclosed herein have applicability to both types of reflector surfaces.

Also, it should be noted that the phase shift caused by each element 102 of the array with respect to reflected or transmitted waves varies significantly in the transition region between passband and stopband. Accordingly, it can be desirable in certain circumstances to configure the slot array to operate in this region. In particular, operation in this transition region can potentially provide substantial phase variation with only a small amount of variation in fluid volume.

Composition of the Fluidic Dielectric

The fluidic dielectric as described herein can be comprised of any fluid composition having the required characteristics of permittivity and permeability as may be necessary for achieving a selected range of phase shift and impedance matching. For example, those skilled in the art will recognize that one or more component parts can be mixed together to produce a desired permeability and permittivity required for achieving a particular phase shift and impedance match to free space for a particular element 102.

The fluidic dielectric 300 also preferably has a relatively low loss tangent to minimize the amount of RF energy lost in each element. However, devices with higher loss may be acceptable in some instances so this may not be a critical factor. Many applications also require a broadband response. Accordingly, it may be desirable in many instances to select fluidic dielectrics that have a relatively constant response over a broad range of frequencies.

Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the fluidic dielectric as described herein, it should be noted that the invention is not so limited. Instead, the composition of the fluidic dielectric could be formed in other ways. All such techniques will be understood to be included within the scope of the invention.

Those skilled in the art will recognize that a nominal value of permittivity ($\epsilon_1$) for fluids is approximately 2.0. However, the fluidic dielectric used herein can include fluids with higher values of permittivity. For example, the fluidic dielectric material could be selected to have a permittivity values of between 2.0 and about 58, depending upon the amount of phase shift required.

Similarly, the fluidic dielectric can have a wide range of permeability values. High levels of magnetic permeability are commonly observed in magnetic metals such as Fe and Co. For example, solid alloys of these materials can exhibit levels of $\mu$, in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organometallic compounds, and other derivatives, although Fe and Co particles are most common. The size of the magnetic particles found in such systems is known to vary to some extent. However, particles sizes in the range of 1 nm to 20 $\mu$m are common. The composition of particles can be selected as necessary to achieve the required permeability in the final fluidic dielectric. Magnetic fluid compositions are typically between about 50% to 90% particles by weight. Increasing the number of particles will generally increase the permeability.

More particularly, a hydrocarbon dielectric oil such as Vacuum Pump Oil MSDS-12602 could be used to realize a low permittivity, low permeability fluid, low electrical loss fluid. A low permittivity, high permeability fluid may be realized by mixing same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivity.

Similar techniques could be used to produce fluidic dielectrics with higher permittivity. For example, fluid permittivity could be increased by adding high permittivity powders such as barium titanate manufactured by Ferro Corporation of Cleveland, Ohio. For broadband applications, the fluids would not have significant resonances over the frequency band of interest.

Array Structure, Materials and Fabrication

According to one aspect of the invention, the dielectric substrate 106 can be formed from a ceramic material. For example, the dielectric structure can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention.

Beam Control Process

Figure 7:
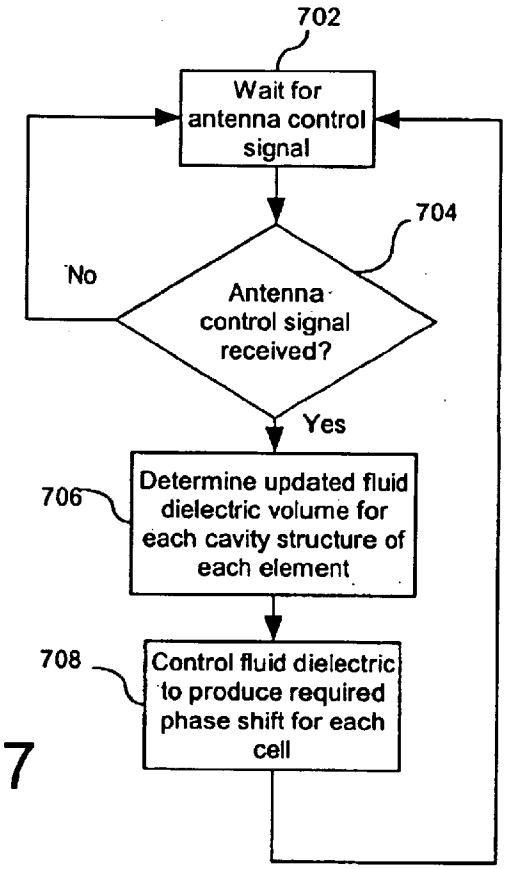
FIG. 7 is a flowchart that is useful for understanding a method for steering an antenna beam using the FSS.

Referring now to FIG. 7, a process shall be described for controlling the angle of a redirected RF beam using the slot array 100. In step 702 and 704, controller 302 can wait for an antenna control signal 301 indicating a requested angle for a redirected beam. Once this information has been received, the controller 302 can determine in step 706 a required phase shift for each element 102 and/or a required amount of fluid dielectric 300 that is needed for each cavity structure 202 in order to produce the required phase shift. In step 708, the controller 302 can selectively operate the control pumps 206 and valves 207 respectively associated with each element 100 to produce the required phase shift in each element of the slot array.

As an alternative to calculating the required configuration of the fluid dielectric, the controller 302 could also make use of a look-up-table (LUT). The LUT can contain cross-reference information for determining control data for each element 102 necessary to achieve various redirected beam angles. For example, a calibration process could be used to identify the specific sensor output data communicated to controller 302 necessary to achieve a specific angle for the redirected beam. These digital control signal values could then be stored in the LUT. Thereafter, when control signal 301 is updated, the controller 302 can immediately operate the pumps 206 and valves 207 for each element to produce the sensor output data for each cell that is required to produce the redirected beam angle or shape indicated by the control signal 301.

As an alternative, or in addition to the foregoing methods, the controller 302 could make use of an empirical approach that applies a reference signal to each radiating element and then measures the phase shift that occurs at each element 100. Specifically, the controller 302 can check to see whether the updated phase shift for each element has been achieved. A feedback loop could then be employed to control each pump 206 and valve 207 to produce the desired redirected beam angle or shape.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A system for controlling an antenna beam, comprising:

a slot array having a plurality of slot elements;

a fluid control system responsive to a control signal, said fluid control system independently varying a selected volume of a fluid dielectric coupled to each of said slot elements for at least one of steering and shaping an electromagnetic field.

2. The system according to claim 1 wherein said slot array is comprised of a conductive sheet having a plurality of slot elements formed as shaped perforations in the conductive sheet.

3. The system according to claim 2 wherein said conductive sheet is disposed over a dielectric substrate.

4. The system according to claim 3 wherein said fluid control system is at least partially shielded from said electromagnetic field by said conductive sheet.

5. The system according to claim 3 wherein said slot array is further comprised of an array of cavity structures defined within said dielectric substrate for containing said fluid dielectric coupled to said slot elements.

6. The system according to claim 1 wherein said fluid control system is comprised of one or more fluid control components selected from the group consisting of a fluid reservoir, a pump, a valve and a controller.

7. The system according to claim 1 wherein said slot array is a frequency selective surface.

8. The system according to claim 7 wherein said frequency selective surface is transmissive of said electromagnetic field at a predetermined operating frequency corresponding to said electromagnetic field.

9. The system according to claim 7 wherein said frequency selective surface is reflective of said electromagnetic field at a predetermined operating frequency corresponding to said electromagnetic field.

10. The system according to claim 7 wherein said frequency selective surface has a stopband, a passband, and a transition region between said stopband and said passband, and said slot array is configured for operation in said transition region at a predetermined frequency corresponding to said electromagnetic field.

11. The system according to claim 1 wherein said slot array further comprises at least one conductive ground plane for reflecting said electromagnetic field.

12. The system according to claim 1 further comprising a fixed beam source for said electromagnetic field.

13. The system according to claim 1 wherein said slot elements are tripoles.

14. The system according to claim 13 wherein said fluid dielectric is constrained in an area corresponding to an intersection of each arm of said tripole.

15. A slot array, comprising:

a conductive sheet disposed over a dielectric substrate and having a plurality of slot elements formed as shaped perforations in the conductive sheet;

an array of cavity structures defined within said dielectric substrate, each respectively coupled to at least one of said slot elements; and a fluid control system for selectively varying a volume of fluid dielectric contained in each of said cavity structures for at least one of steering and shaping an incident electromagnetic field.

16. A method for controlling an electromagnetic field, comprising the steps of:

positioning a slot array in a path of an incident electromagnetic field; and selectively varying a volume of a fluid dielectric coupled to each of a plurality of slot elements of said slot array so as to modify at least one of a direction of travel of said electromagnetic field and a shape of said electromagnetic field.

17. The method according to claim 16 further comprising the step of shielding at least a portion of a fluid control system from said electromagnetic field with a conductive sheet defining said slot elements.

18. The method according to claim 16 further comprising the step of constraining said fluid dielectric in an array of dielectric cavity structures.

19. The method according to claim 16 further comprising the step of configuring said slot array as a frequency selective surface.

20. The method according to claim 19 further comprising the step of configuring said slot array to be transmissive of said electromagnetic field at a predetermined operating frequency corresponding to said electromagnetic field.

21. The method according to claim 19 further comprising the step of configuring said slot array to be reflective of said electromagnetic field at a predetermined operating frequency corresponding to said electromagnetic field.

22. The method according to claim 19 further comprising the step of configuring said slot array so as to have a transition region between a stopband and a passband, and selecting a frequency of said electromagnetic field to be within a frequency range defined by said transition region.

23. The method according to claim 16 further comprising the step of reflecting said electromagnetic field incident on said slot array using a ground plane.

24. The method according to claim 16 further comprising the step of illuminating said slot array with an electromagnetic field from a fixed beam source.

25. The method according to claim 16 further comprising the step of selecting said slot elements to have a tripole configuration.

26. The method according to claim 25 further comprising the step of constraining said fluid dielectric in an area corresponding to an intersection of each arm of said tripole.

* * * * *